US006341835B1

(12) United States Patent
Ogawa et al.

(10) Patent No.: US 6,341,835 B1
(45) Date of Patent: Jan. 29, 2002

(54) RECORDING DEVICE INCLUDING BUFFER MECHANISM FOR TRANSPORTING RECORDING MEDIUM IN FORWARD AND REVERSE DIRECTIONS

(75) Inventors: Toshitaka Ogawa; Toshio Hiki, both of Hitachinaka (JP)

(73) Assignee: Hitachi Koki, Co., Ltd., Tokyo (JP)

( * ) Notice: Subject to any disclaimer, the term of this patent is extended or adjusted under 35 U.S.C. 154(b) by 0 days.

(21) Appl. No.: 09/453,811

(22) Filed: Dec. 3, 1999

(30) Foreign Application Priority Data

Dec. 4, 1998 (JP) ..... 10-344956

(51) Int. Cl.[7] ..... B41J 2/21
(52) U.S. Cl. ..... 347/16; 347/104; 347/215
(58) Field of Search ..... 347/76, 43, 44, 347/104, 105, 115, 117, 153, 187, 215, 218, 221

(56) References Cited

U.S. PATENT DOCUMENTS 5,886,715 A * 3/1999 Fukuoka ..... 347/33
6,012,809 A * 1/2000 Ikeda et al. ..... 347/101
6,068,366 A * 5/2000 Bolash et al. ..... 347/43

* cited by examiner

*Primary Examiner*—Anh T. N. Vo
(74) *Attorney, Agent, or Firm*—Whitham, Curtis & Christofferson, P.C.

(57) ABSTRACT

A recording sheet is positioned at one of a plurality of starting positions based on a printing mode used in previous printing operations. When printing operations are started in a printing mode different from the previous printing mode, the recording sheet is transported either in a forward direction or in a reverse direction to a corresponding starting position. Then, actual printing is started. On the other hand, when printing operations are started in the same printing mode, actual printing is started immediately. In this way, printing speed is improved.

18 Claims, 4 Drawing Sheets

RECORDING DEVICE INCLUDING BUFFER MECHANISM FOR TRANSPORTING RECORDING MEDIUM IN FORWARD AND REVERSE DIRECTIONS

BACKGROUND OF THE INVENTION

1. Field of the Invention

The present invention relates to an image forming device and a method for forming images on recording sheets that are transported consecutively one at a time.

2. Description of the Related Art

FIG. 1 shows a conventional ink jet recording device 100 that performs printing operations. During the printing operations, recording sheets are fed from a hopper 30 one at a time and transported along a sheet path in a direction indicated by an arrow T. A head unit 2 forms an image on a recording sheet, and the recording sheet with the image formed thereon is discharged onto a tray 40.

The head unit 2 includes a plurality of recording heads 3, 4, 5, 6 for black color, magenta color, yellow color, and cyan color, respectively. The recording heads 3, 4, 5, 6 are aligned in a row in the direction T and each has a nozzle surface facing downward. Although nut shown in the drawings, each nozzle surface is formed with a plurality of nozzle lines each extending in a direction perpendicular to a sheet surface of FIG. 1. Each nozzle line includes a plurality of nozzles through which an ink droplet is ejected.

Because each recording head 3, 4, 5, 6 includes a plurality of nozzle lines, printed images have high quality and high ink dot density. However, because each recording head 3, 4, 5, 6 has more than one nozzle lines, the width of the head unit 2 can be as great as four inches in the direction T. In other words, the head unit 2 is wider than if each recording head 3, 4, 5, 6 included only a single nozzle line.

The ink jet recording device 100 can print using a monochromatic printing mode, a bicolor printing mode, or a fullcolor printing mode. In the monochromatic printing mode, monochromatic images are formed using only the recording head 3. In the bicolor printing mode, bicolor images are formed using any two of the recording heads 3, 4, 5, 6. In other words, the bicolor printing mode includes a black-magenta bicolor printing mode, a black-yellow bicolor printing mode, a black-cyan bicolor printing mode, a magenta yellow bicolor printing mode, a magenta-cyan bicolor mode, and a yellow-cyan bicolor mode. In the fullcolor printing mode, fullcolor images are formed using all of the recording heads 3, 4, 5, 6.

In order to improve printing speed, a sheet feed mechanism 31 consecutively transport a plurality of recording sheets one at a time such that each two adjacent recording sheets are separated by a distance shorter than the width W1 of the head unit 2. Also, a recording sheet is positioned at a predetermined starting position each time printing operation are completed. At the predetermined starting position, a leading edge of the recording sheet is positioned immediately upstream from the head unit 2 in the direction T, so that the next printing operations can be started quickly.

If the recording sheet was positioned further downstream than the predetermined starting position, then at least a portion of the recording sheet would be positioned beneath the head unit 2. This would lead to the following problems. For example, if next printing operations were restarted in the fullcolor mode, a portion of a fullcolor image could not be formed on the recording sheet. Also, the recording sheet beneath the head unit 2 would interfere with a maintenance mechanism (not shown), which accesses the nozzle surfaces of the recording heads 3, 4, 5, 6 from the below and performs maintenance operations on the recording heads 3, 4, 5, 6 when printing operations have not been performed for a certain time. Because of these reasons, the recording sheet needs to be upstream side of the head unit 2 when printing operations and not being performed.

However, when printing operations are repeatedly and intermittently performed in the monochromatic printing mode, pretransporting operations are performed each time printing operations are restarted. Specifically, in the monochromatic printing mode, only the recording head 3 is used. Therefore, the recording sheet that is positioned at the predetermined starting position needs to be transported by a distance L1 to a position where the leading edge of the recording sheet is positioned immediately upstream from the recording head 3. Then, actual printing is started using the recording head 3. Because actual printing is not performed until the pretransporting operations are completed, the pretransporting operations waste time and reduce printing speed.

SUMMARY OF THE INVENTION

It is an objective of the present invention to overcome the above problems, and also to provide an image forming device and a method for performing printing operations at an improved recording speed.

In order to achieve the above and other objectives, there is provided a recording device including a head unit and a buffer mechanism. The head unit includes a plurality of recording heads aligned in a first direction. The head unit performs printing operations for forming an image on a recording medium using at least one of the recording heads based on print data. The buffer mechanism transports the recording medium selectively in the first direction and a second direction opposite from the first direction. The buffer mechanism is provided upstream from the head unit in the first direction.

There is also provided a printing method including the steps of a) performing printing operations based on print data for forming an image on a recording medium, and b) positioning a subsequent recording medium at one of a plurality of starting positions corresponding to the print data.

BRIEF DESCRIPTION OF THE DRAWINGS

The particular features and advantages of the invention as well as other objects will become more apparent from the following description taken in connection with the accompanying drawings, in which.

DETAILED DESCRIPTION OF THE PREFERRED EMBODIMENT

An image forming device according to a preferred embodiment of the present invention will be described while referring to the accompanying drawings.

Figure 1:
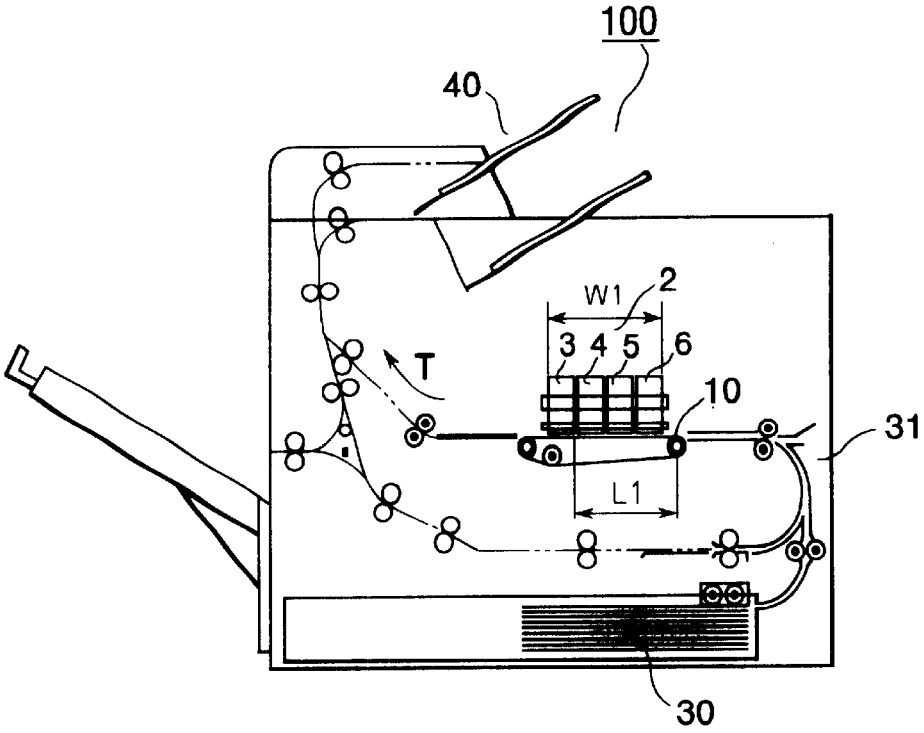
FIG. 1 PRIOR ART
FIG. 1 is a plan view showing a conventional ink jet recording device.
Figure 2:
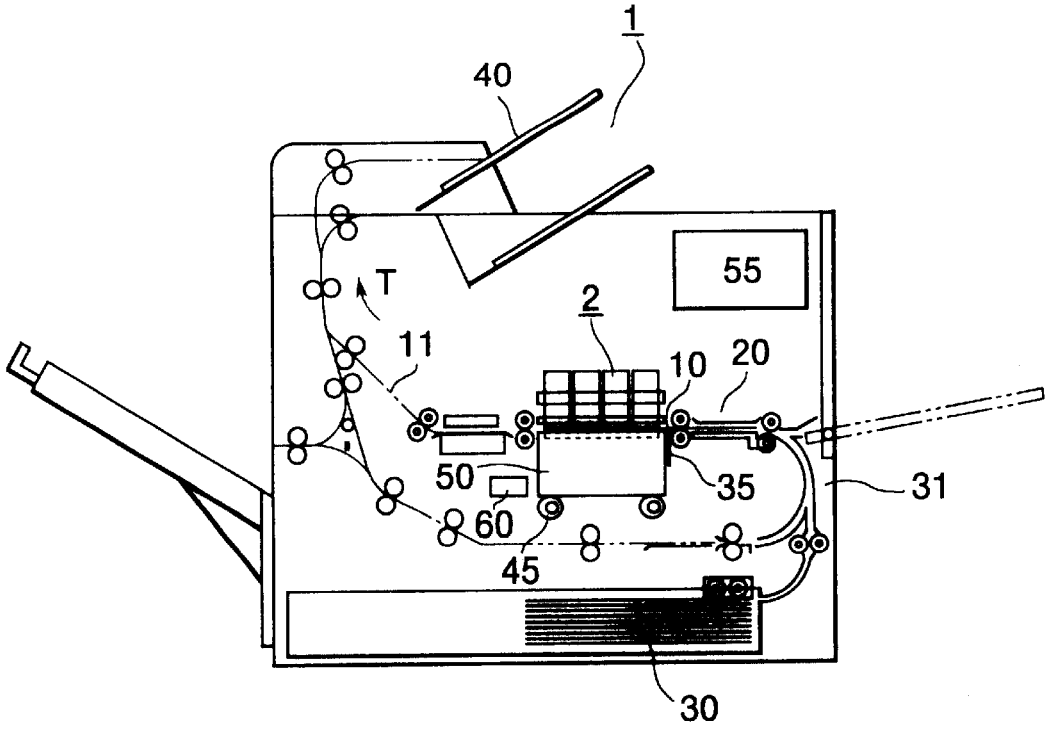
FIG. 2 is a plan view showing an ink jet recording device according to an embodiment of the present invention.

As shown in FIG. 2, an ink jet recording device 1 according to an embodiment of the present invention includes a head unit 2, a buffer mechanism 20, a hopper 30, a sheet feed mechanism 31, a sheet sensor 35, a tray 40, a moving mechanism 45, a head maintenance mechanism 50, a control unit 55, and a head sensor 60. Because the configuration of the head unit 2 is the same as that of the conventional ink jet recording device 100, detailed explanations will be omitted to avoid duplication of explanation.

The ink jet recording device 1 performs printing operations in one of the monochromatic printing mode, the bicolor printing mode, and the full color printing mode. After printing operations, the ink jet recording device 1 aligns a recording sheet, depending on the printing mode, at one of four starting positions, indicated by lines A, B, C, D, in FIG. 3, corresponding to the recording heads 3, 4, 5, 6. When a recording sheet is positioned at one of the starting positions A, B, C, D, the leading edge of the recording sheet is aligned on one of the lines A, B, C, D immediately upstream form the corresponding recording heads 3, 4, 5, 6 in the direction T.

Specifically, After printing operations in the monochromatic mode using the recording head 3, the recording sheet is positioned at the starting positions A corresponding to the recording head 3. After printing operations in the bicolor mode, the recording sheet is positioned at one of the starting positions B, C, D corresponding to upstream one of the two recording heads 3, 4, 5, 6 which are used in the bicolor mode. For example, in the magenta-cyan bicolor printing mode using the recording heads 4, 6, the recording sheet is positioned at the starting position D corresponding to the recording head 6 which is located upstream from the recording head 4. However, in the black-magenta bicolor printing mode using the recording heads 3, 4, the recording sheet is positioned at the starting position B corresponding to the recording head 4 which is located upstream from the recording head 3. After printing operations in the fullcolor mode, the recording sheet is positioned at the starting position D because the recording head 6 is the most upstream one of the recording heads 3, 4, 5, 6.

The sheet sensor 35 is provided downstream from the buffer mechanism 20 in the direction T. Although not shown in the drawings, the sheet sensor 35 includes an optical sensor and a light emission diode (LED). The LED radiates an optical beam, and the optical sensor detects the optical beam reflected off the recording sheet, thereby detecting the presence of the recording sheet and the position of the leading edge of the recording sheet.

The head maintenance mechanism 50 is positioned beneath the head unit 2, and performs maintenance operations, such as cleaning operations and capping operations, on the recording heads 3, 4, 5, 6. The moving mechanism 45 moves the head maintenance mechanism 50 selectively to a retracted position and an active position. Usually, the head maintenance mechanism 50 is at the retracted position away from the head unit 2. However, the head maintenance mechanism 50 is moved into the active position to perform maintenance operations when required. It should be noted that when the head maintenance mechanism 50 performs maintenance operations, a recording sheet is placed at an initial position E where the recording sheet does not interfere with the maintenance mechanism 50.

In the present embodiment, the head maintenance mechanism 50 is configured so as to cover the entire nozzle surfaces of the recording heads 3, 4, 5, 6. For this reason, the initial position E is set slightly upstream from the starting position D. However, the initial position E and the starting position D is substantially the same position. Instead of the head maintenance mechanism 50, a compact-sized head maintenance mechanism can be used. The compact sized head maintenance mechanism has a width smaller than the unit width W1 so as to cover portions of the nozzle surfaces where the nozzle lines are formed. In this case, because a recording sheet positioned at the starting position D will not interfere with the head maintenance mechanism, the starting position D and an initial position can be exactly the same.

For the above reasons, in the present embodiment, the initial position E is considered as the same as the starting position D.

The head sensor 60 is positioned adjacent to the head maintenance mechanism 50, and detects the position of the head maintenance mechanism 50.

Figure 3:
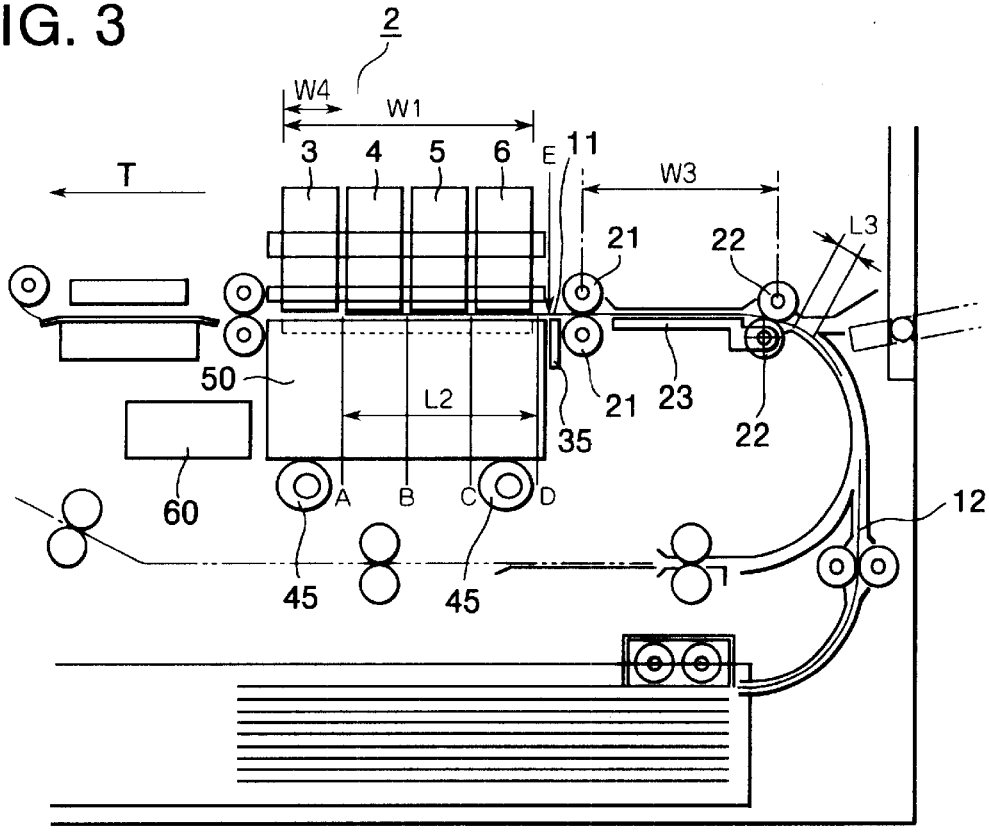
FIG. 3 is a particularly magnified view showing the ink jet recording device of FIG. 2.

As shown in FIG. 3, the hopper 30 is positioned at lower portion of the ink jet recording device 1 and houses a plurality of recording sheet sin a stacked condition. Each of the recording sheets has a sheet width W2, which is larger than the unit width W1.

Figure 4:
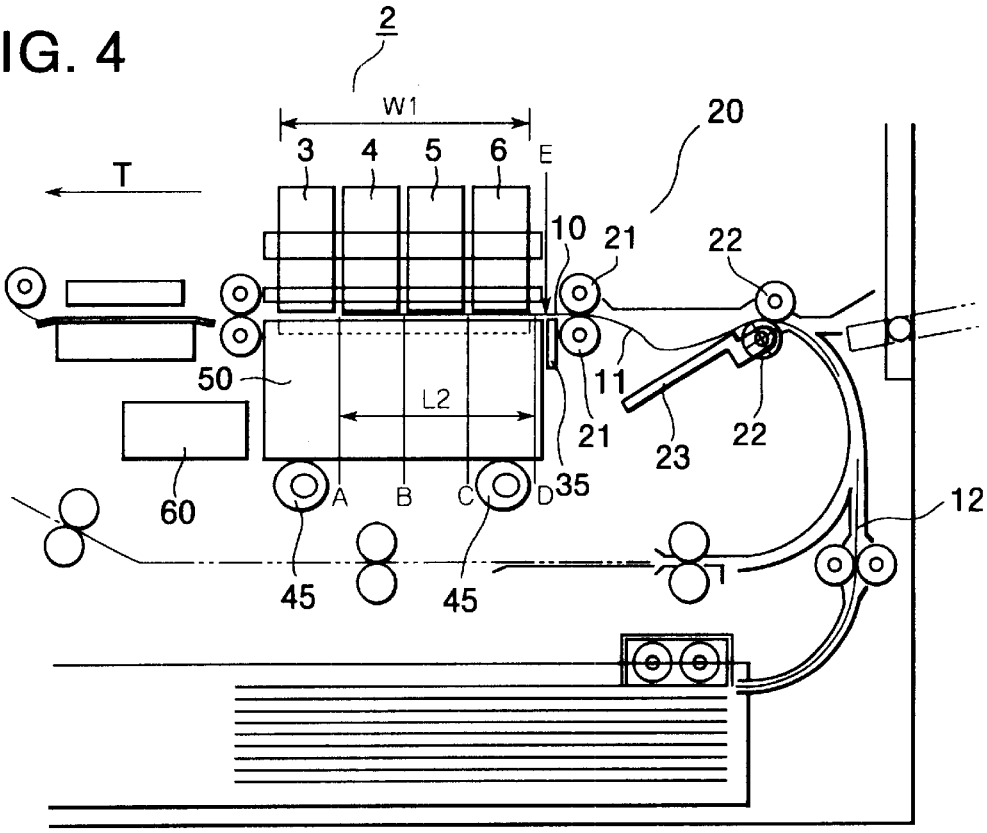
FIG. 4 is a partially magnified view showing the ink jet recording device of FIG. 2.

The buffer mechanism 20 is provided upstream from the head unit 2 in the direction T, and is for transporting a recording sheet in both the direction T, and in a reverse direction which is opposite the direction T. As shown in FIGS. 3 and 4, the buffer mechanism 20 includes a pair of first feed rollers 21, a pair of second feed rollers 22, and a gate 23. The first feed rollers 21 are capable of rotating both in a forward direction and a reverse direction. However, the second rollers 22 are capable of rotating only in the forward direction.

Usually, the gate 23 is closed as shown in FIG. 3. However, when a recording sheet is transported in the reverse direction, the gate 23 opens as shown in FIG. 4. Then, the pair of feed rollers 21 rotate in the reverse direction while the pair of feed rollers 22 remain stationary. As a result, the recording sheet 11 sags down as shown in FIG. 4.

A distance by which the buffer mechanism 20 transports the recording sheet in the reverse direction is called a buffer distance. The buffer mechanism 20 transports a recording sheet from the starting positions A to the starting position D (the initial position E) by a maximum buffer distance L2. The maximum buffer distance L2 is set equal to or smaller than the difference between the unit width W1 and a head width W4 of the recording head 3 ($L2 \leqq W1-W4$).

Also, the roller width W3 is set smaller than the difference between the sheet width W2 and the maximum buffer distance L2 ($W3<W2-L2$).

With this configuration, when a recording sheet is at the starting position A, a rear edge of the recording sheet is at the upstream side of the feed rollers 27. Therefore, when the recording sheet aligned with the starting position A is transported in the reverse direction, a rear portion of the recording sheet will remain supported between the second feed rollers 22 without dropping down.

As shown in FIG. 3, when a plurality of recording sheets are subsequently transported one at a time during printing operations, each two adjacent recording sheets are separated by a distance L3, which is smaller than the unit width W1 so that the printing speed is improved. In the present embodiment, the distance L3 is set to approximately 1 inch.

Figure 6:
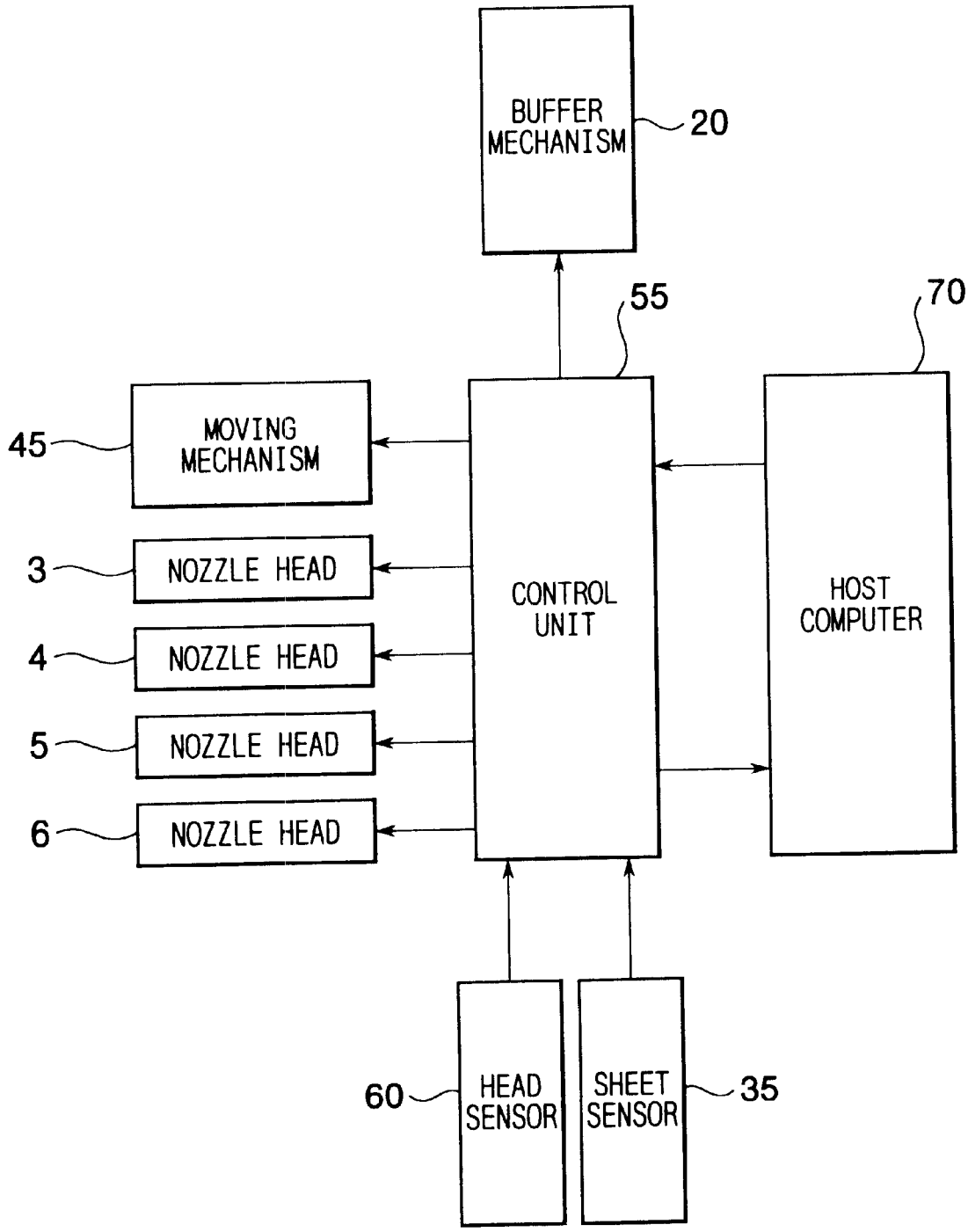
FIG. 6 is a block diagram showing a control configuration of the embodiment of the present invention.

As shown in FIG. 6, the control unit 55 is connected to an external device 70, such as a host computer, and receives various data therefrom. Also, the control unit 55 is individually connected and controls each of the recording heads 3, 4, 5, 6, the buffer mechanism 20, the moving mechanism 45, the sheet sensor 35, and the head sensor 60.

Next, operations of the ink jet recording device 1 will be described.

When printing operations are completed, a recording sheet is placed at one of the starting positions A, B, C, D, depending on the printing mode as described above. Then, when subsequent printing operations are started in the same printing mode, the subsequent printing operations can be immediately started without any pretransporting operations.

However, when subsequent printing operations are performed in a printing mode different from a printing mode of previous printing operations, the pretransporting operations are performed to position the recording sheet at a corresponding one of the starting positions A, B, C, D.

For example, when printing operations in the bicolor printing mode are performed after printing operations in the monochromatic printing mode, the recording sheet is transported in the reverse direction from the starting position A to one of the starting positions B, C, D. When printing operation in the fullcolor printing mode are performed after printing operations in the monochromatic printing mode, the recording sheet is transported in the reverse direction from the starting position A to the starting position D. When printing operations in the fullcolor printing mode are performed after printing operations in the bicolor printing mode, a recording sheet may be transported in the reverse direction from one of the starting positions B, C to the starting position D.

On the other hand, when printing operations are performed in the monochromatic printing mode after printing operations in the bicolor printing mode or the fullcolor printing mode, a recording sheet is transported in the direction T from one of the starting positions B, C, D to the starting position A. In this case, in addition to the recording sheet, a subsequent recording sheet following the recording sheet is also transported by the same distance. This is the same as in the case when printing operations are performed to the bicolor printing mode after the printing operations in the fullcolor printing mode.

Figure 5:
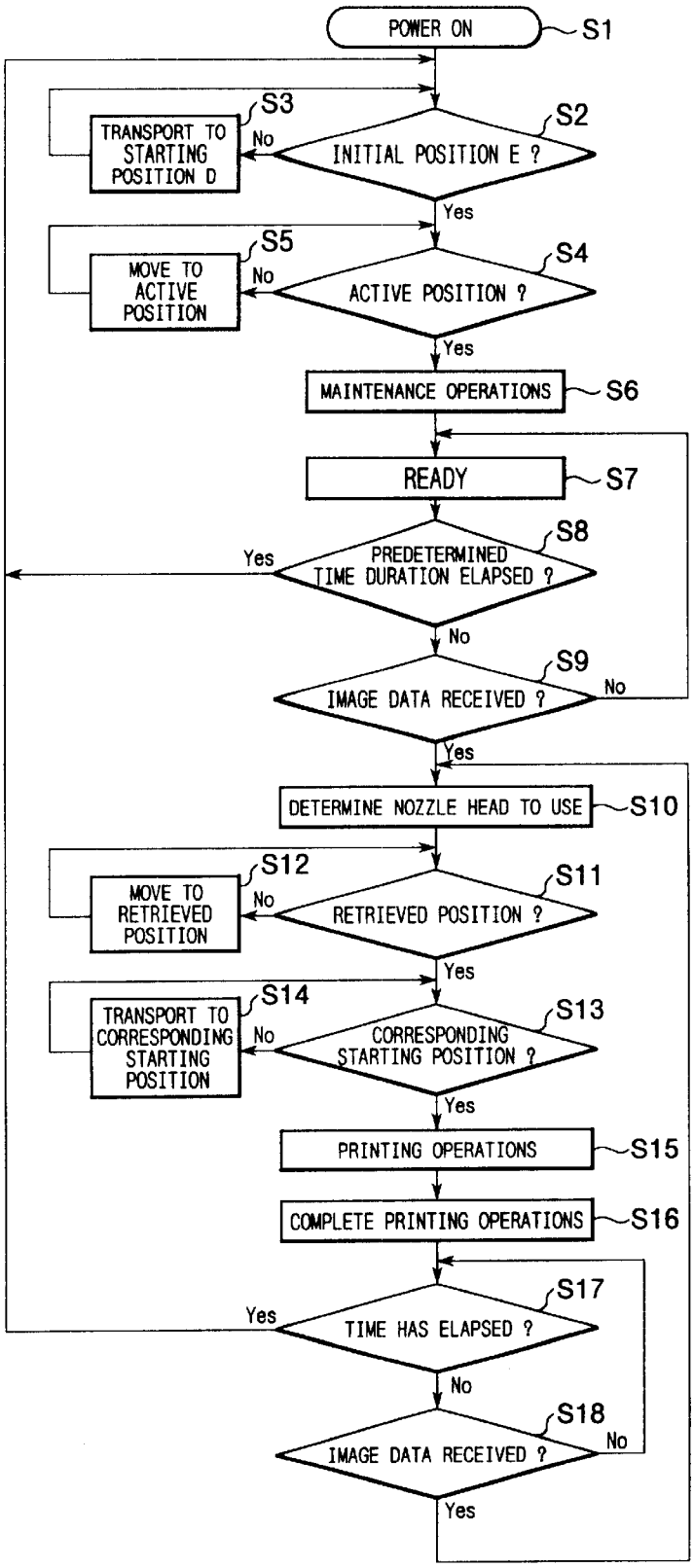
FIG. 5 is a flowchart representing a control program of the ink jet recording device of the embodiment of the present invention.

Next, control program of the above-described operations of the ink jet recording device will be described while referring to the flowchart shown in FIG. 5.

First, in S1, the ink jet recording device 1 is powered ON. Next in S2, it is determined whether or not a recording sheet is positioned at the initial position E based on a detection signal from the sheet sensor 35. If not (S2:NO), a recording sheet is transported and placed at the initial position E, and the routine repeats S2. On the other hand, if so (S2:YES), then in S4, it is determined whether or not the head maintenance mechanism 50 is in the active position based on a detection signal from the head sensor 60. If so (S4:YES), the routine proceeds to S6. On the other hand, if not (S4:NO), the routine proceeds to S5. In S5, the moving mechanism 45 moves the maintenance mechanism 50 to the active position, and the routine returns to S4.

In S6, the maintenance mechanism performs maintenance operations, such as purging operations and wiping operations. The purging operations are well known operations wherein ink droplets are selected from nozzles of each recording head 3, 4, 5, 6. The wiping operations are for cleaning the nozzle surfaces of recording heads 3, 4, 5, 6. Then, in S7, the ink jet recording device 1 is set in a waiting mode.

In S8, it is determined whether or not a predetermined time duration has elapsed since S6, if so (S8:YES), the routine returns to S2. If not (S8:NO), then in S9, it is determined whether or not image data is received from the host computer 70. If not (S9:NO), the routine returns to S8. On the other hand, if so (S9:YES), the routine proceeds to S10: In this example, it is assumed that monochromatic image data is received in S9.

In S10, it is determined which one ones of the recording heads, 3, 4, 5, 6 is used for printing the image data which has been received in S9. In this example, because the monochromatic image data has been received in S9, it is determined that only the recording head 3 is used.

However, if bicolor image data for a black-magenta bicolor image, for example, is received in S9, it is determined in S10 that the recording heads 3, 4 are used. If fullcolor image data is received in S9, it is determined in S10 that all of the recording heads 3, 4, 5, 6 are used.

Next in S11, it is determined whether or not the head maintenance mechanism 50 is at the retracted position. If so (S11:YES), the routing proceeds to S13. If not (S11:NO), then in S12, the moving mechanism 45 moves the head maintenance mechanism 50 to the retracted position, and the routine returns to S11.

In S13, it is determined whether or not a recording sheet is placed at corresponding one of the starting positions A, B, C, D based on a detection signal from the sheet sensor 35. In this example, because only the recording head 3 is used in the monochromatic printing mode, it is determined whether or not the recording sheet is placed at the starting position A. If so (S13:YES), the routine proceeds to S15. If not (S13:NO), the recording sheet is transported to the starting position A. Then, the routine returns to S13.

In S15, printing operations are performed, and then in S16, the printing operations are completed. Also, in S16, a recording sheet is placed at a corresponding starting position, that is, at the starting position A in this example.

Next in S17, it is determined whether or not a predetermined time duration, for example 10 minutes, has elapsed since the printing operations have been completed in S15. If so (S17:YES), the routine returns to S2. On the other hand, if not (S17:NO), then in S18, it is determined whether or not subsequent image data is received from the host computer 70. If not (S18:NO), the routine returns to S16. If so (S18:YES), the routine returns to S10.

Therefore, if subsequent monochromatic image data is received in S18, printing operations in the monochromatic printing mode can be immediately started because the recording sheet has already been positioned at the starting position A. As a result, printing speed can be improved.

Although description has been provided above for the monochromatic printing mode, the same effects can be obtained as long as printing operations are performed in the same printing mode as per.

When printing operations are performed in a printing mode different, from a previons printing mode, the pretransporting operations are performed. However, the maximum buffer distance L2 is no larger than the distance L1 of the conventional device. Therefore, high printing speed can be maintained in this case also.

It should be noted that, as shown in FIG. 3, when a recording sheet 11 is at the starting position A, a recording sheet 12, which follows the recording sheet 11, is positioned behind the recording sheet 11 as described above. Therefor, if entire the recording sheet 11 is transported in the reverse direction while the recording sheet 12 is maintenance stationary, the rear edge of the recording sheet 11 will abut against the leading edge of the recording sheet 12, thereby causing a paper jam. However, according to the present invention, when the recording sheet 11 is transported in the reverse direction, the recording sheet 11 sags down as shown in FIG. 4, without the rear edge of the recording sheet 11 moving in the reverse direction. Therefore, a paper jam is effectively prevented.

Although it is conceivable to transport both the recording sheet 11 and the recording sheet 12 in the reverse direction until the recording sheet 11 reaches the starting positive D, such transport operations could easily cause a paper jam. Because only the recording sheet 11 is transported according to the present invention, paper jams can be prevented.

Also, according to the present invention, when maintenance operations are required, a recording sheet at any one of the starting positions A, B, C, D is transported back to the initial position E. Therefore, the maintenance mechanism 50 can access to the recording heads 3, 4, 5, 6 and can perform the maintenance operations.

While the invention has been described in detail with reference to specific embodiments thereof, it would be apparent to those skilled in the art that various changes and modifications may be made therein without departing from the spirit of the invention, the scope of which is defined by the attached claims.

For example, in the above-described embodiment, the head unit 2 includes four recording heads 3, 4, 5, 6. However, the head unit 2 can include more than or less than four recording heads.

Also, a plurality of sheet sensors can be provided, each for a corresponding one of the recording heads 3, 4, 5, 6. In this way, the position of the recording sheet can be detected more precisely, thereby enabling precise sheet transport operations.

Further, any type of sensor, such as an encoder sensor, can be used rather than the sheet sensor 35 for detecting a position of a recording sheet. Alternatively, a counter that counts rotation number of the feed rollers 21 can be used to measure the transported distance of a recording sheet.

Although in the above-described embodiment, the recording heads 3, 4, 5, 6 for black color, magenta color, yellow color, cyan color, respectively, are aligned in this order in the direction T, the recording heads 3, 4, 5, 6 can be aligned in any order. Also, any one of the recording heads 4, 5, 6 can be used in the monochromatic printing mode rather than the recording head 3 for black color. In such cases, starting positions should be set accordingly.

What is claimed is:

1. A recording head device comprising:

a head unit including a plurality of recording heads aligned in a first direction, the head unit performing printing operations for forming an image on a recording medium using at least one of the recording heads based on print data, the head unit has a unit width in the first direction and each of the plurality of recording heads has a head width in the first direction; and a buffer mechanism that transports the recording medium selectively in the first direction and a second direction opposite from the first direction, the buffer mechanism being provided upstream from the head unit in the first direction, wherein a maximum distance by which the buffer mechanism transports the recording medium in the second direction is equal to or smaller than a difference between the unit width and the head width.

2. The recording device according to claim 1, wherein the recording medium has a medium length in the first direction, and the buffer mechanism includes a first feed roller and a second feed roller, the first feed roller rotating in two rotational directions, the second feed roller rotating in one rotational direction, the second feed roller being positioned upstream from the first feed roller in the first direction, wherein a roller distance between the first feed roller and the second feed roller is shorter than a difference between the medium length and the maximum distance, and the medium length is greater than the maximum distance.

3. The recording device according to claim 2, wherein the buffer mechanism further includes a gate or supporting the recording medium, wherein the gate opens when the recording medium is transported in the second direction such that the recording medium sage down between the first feed roller and the second feed roller.

4. The recording device according to claim 1, further comprising a transporting unit that transports a plurality of recording mediums consecutively one at a time in the first direction such that a medium distance between each two adjacent recording mediums is shorter than the unit width.

5. The recording device according to claim 4, wherein when the printing operations are completed, the transporting unit transports a next recording medium to a corresponding one of a plurality of starting positions where a leading edge of the next recording medium is positioned, with respect to the first direction, immediately upstream from a most upstream one of the at least one of the recording heads which are used during the printing operations.

6. The recording device according to claim 5, wherein the head unit performs the printing operations according to one of a plurality of printing modes, wherein each of the plurality of starting positions corresponds to one of the plurality of printing modes.

7. The recording device according to claim 1, wherein when a predetermined time duration elapses since the printing operations have been completed, the buffer mechanism transports the recording medium in the second direction to an initial position where a leading edge of the recording medium is positioned immediately upstream from the head unit in the first direction.

8. The recording device according to claim 1, further comprising a maintenance mechanisms positioned selectively at an active position and a retracted position away from the active position, the maintenance mechanism performing maintenance operations on the recording heads at the active position.

9. The recording device according to claim 8, further comprising a first sensor provided upstream from the head unit for detecting the recording medium, a second sensor provided adjacent to the maintenance mechanism for detecting the maintenance mechanism, and a control unit that controls the head unit and the buffer mechanism based on detection signals from the first sensor and the second sensor and further on the print data.

10. The recording device according to claim 1, wherein the recording heads are ink jet recording heads each formed with a nozzle through which an ink droplet in ejected.

11. A printing method comprising the steps of:

a) performing printing operations based on print data for forming an image on a recording medium by a head unit including a plurality of recording heads aligned in a first direction, the head unit having a unit width in the first direction and each of the plurality of recording heads having a head width in the first direction; and b) positioning a subsequent recording medium at one of a plurality of starting positions corresponding to the print data by selectively transporting the recording medium in the first direction and a second direction opposite from the first direction, wherein a maximum distance by which the recording medium is transported in the second direction is equal to or smaller than a difference between the unit width and the head width.

12. The printing method according to claim 11, further comprising the steps of:

c) receiving subsequent print data;

d) detecting whether or not the subsequent recording medium is positioned at one of a plurality of starting positions corresponding to the subsequent print data; and e) when detection made in detecting step d) is negative, transporting the recording medium to one of the starting positions corresponding to the subsequent print data.

13. A printing method comprising the steps of:

a) performing printing operations based on print data for forming an image on a recording medium;

b) positioning a subsequent recording medium at one of a plurality of starting positions corresponding to the print data;

c) receiving subsequent print data;

d) detecting whether or not the subsequent recording medium is positioned at one of the plurality of starting positions corresponding to the subsequent print data; and e) when detection made in step d) is negative, transporting the recording medium to the one of the starting positions corresponding to the subsequent print data.

14. The recording method according to claim 13, further comprising the step of f) performing printing operations based on the subsequent print data.

15. The recording method according to claim 13, further comprising the steps of:

g) determining whether or not a predetermined time duration has elapsed before step d) and after step c); and h) when determination made in step g) is affirmative, performing maintenance operation on the recording heads.

16. The recording method according to claim 15, wherein the step h) comprises the steps of:

i) detecting whether or not the recording medium is positioned at an initial position;

j) when detection made in step l) is negative, transporting the recording medium to the initial position; and k) performing at least one of cleaning operations and capping operations.

17. A printing method comprising the steps of:

a) performing printing operations based on print data for forming an image on a recording medium;

b) positioning a subsequent recording medium at one of a plurality of starting positions corresponding to the print data;

c) receiving subsequent print data; and d) performing printing operations based on the subsequent print data for forming a subsequent image on the subsequent recording medium.

18. A recording device comprising:

a head unit including a plurality of recording heads aligned in a first direction, the head unit performing print operations for forming an image on a recording medium using at least one of the recording heads based on print data; and a buffer mechanism that transports a subsequent recording medium selectively in the first direction and a second direction opposite from the first direction to position the recording medium at one of a plurality of starting positions corresponding to the print data.

* * * * *